US011499552B2

(12) United States Patent
Gruber et al.

(10) Patent No.: US 11,499,552 B2
(45) Date of Patent: Nov. 15, 2022

(54) FLUID WORKING SYSTEMS

(71) Applicant: Danfoss Power Solutions GmbH & Co. OHG, Neumunster (DE)

(72) Inventors: Elliott Gruber, Atlanta, GA (US); Luke Wadsley, Ames, IA (US)

(73) Assignee: Danfoss Power Solutions GmbH & Co. OHG, Neumunster (DE)

( * ) Notice: Subject to any disclaimer, the term of this patent is extended or adjusted under 35 U.S.C. 154(b) by 154 days.

(21) Appl. No.: 15/572,226

(22) PCT Filed: May 6, 2016

(86) PCT No.: PCT/US2016/031098
§ 371 (c)(1),
(2) Date: Nov. 7, 2017

(87) PCT Pub. No.: WO2016/182873
PCT Pub. Date: Nov. 17, 2016

(65) Prior Publication Data
US 2018/0135627 A1 May 17, 2018

(51) Int. Cl.
*F04C 15/00* (2006.01)
*F04C 29/00* (2006.01)
(Continued)

(52) U.S. Cl.
CPC ..... *F04C 15/0049* (2013.01); *F04B 11/00* (2013.01); *F04B 11/0091* (2013.01);
(Continued)

(58) Field of Classification Search
None
See application file for complete search history.

(56) References Cited

U.S. PATENT DOCUMENTS 2,342,906 A 2/1944 Smith
2,658,526 A 11/1953 Porter
(Continued)

FOREIGN PATENT DOCUMENTS

CN 103038506 A 4/2013
CN 103717901 A 4/2014
(Continued)

OTHER PUBLICATIONS

International Search Report for PCT Application No. PCT/US2016/031098 dated Aug. 2, 2016.
(Continued)

*Primary Examiner* — Essama Omgba
*Assistant Examiner* — Geoffrey S Lee
(74) *Attorney, Agent, or Firm* — McCormick, Paulding & Huber PLLC

(57) ABSTRACT

A fluid working system such as a pump for displacing a working fluid such as hydraulic fluid or a motor using a working fluid is provided. The system may have a positive displacement machine which includes one or more working chamber with displacement means such as a cylinder with a reciprocating piston. There are also two or more fluid ports to allow the working fluid to flow into and out of the working chamber. The working fluid flows from one fluid port means to another either being forced to do so when pumped or moving the piston when functioning as an engine. The fluid working system has associated therewith a non-dead compliance volume of a material such as syntactic foam. This compliance volume acts to smooth any pressure fluctuations within the working fluid system.

5 Claims, 6 Drawing Sheets

(51) Int. Cl.

| | |
|---|---|
| ***F04C 29/06*** | (2006.01) |
| ***F04B 53/16*** | (2006.01) |
| ***F04B 39/12*** | (2006.01) |
| ***F04C 2/02*** | (2006.01) |
| ***F04C 2/16*** | (2006.01) |
| ***F04C 2/18*** | (2006.01) |
| ***F04C 2/12*** | (2006.01) |
| ***F04C 2/344*** | (2006.01) |
| ***F04C 18/02*** | (2006.01) |
| ***F04C 18/16*** | (2006.01) |
| ***F04C 18/18*** | (2006.01) |
| ***F04C 18/12*** | (2006.01) |
| ***F04C 18/344*** | (2006.01) |
| ***F04C 15/06*** | (2006.01) |
| ***F04C 29/12*** | (2006.01) |
| ***F04B 11/00*** | (2006.01) |

(52) U.S. Cl.

CPC ..... *F04B 39/12* (2013.01); *F04B 53/16* (2013.01); *F04C 2/025* (2013.01); *F04C 2/126* (2013.01); *F04C 2/16* (2013.01); *F04C 2/18* (2013.01); *F04C 2/344* (2013.01); *F04C 15/064* (2013.01); *F04C 18/0215* (2013.01); *F04C 18/126* (2013.01); *F04C 18/16* (2013.01); *F04C 18/18* (2013.01); *F04C 18/344* (2013.01); *F04C 29/0035* (2013.01); *F04C 29/063* (2013.01); *F04C 29/124* (2013.01); *F05C 2253/14* (2013.01)

(56) References Cited

U.S. PATENT DOCUMENTS

| | | | | |
|---|---|---|---|---|
| 2,852,033 | A | 9/1958 | Orser | |
| 2,913,991 | A | 11/1959 | Dolza et al. | |
| 2,929,332 | A | 3/1960 | Pierce | |
| 2,999,466 | A * | 9/1961 | Hornschuch | F04C 2/16 418/154 |
| 3,270,684 | A | 9/1966 | Pasquali et al. | |
| 3,357,358 | A | 12/1967 | Rateau | |
| 3,366,067 | A * | 1/1968 | Kocolowski | F04B 43/0036 417/417 |
| 4,021,152 | A | 5/1977 | Toyoda | |
| 4,032,265 | A | 6/1977 | Miller | |
| 4,076,461 | A * | 2/1978 | Moody, Jr | F04C 29/0014 417/310 |
| 4,221,550 | A | 9/1980 | Pleass | |
| 4,255,094 | A | 3/1981 | Nomura | |
| 4,823,552 | A | 4/1989 | Ezell et al. | |
| 4,836,757 | A | 6/1989 | Curwen et al. | |
| 4,846,642 | A | 7/1989 | Nuber et al. | |
| 4,892,469 | A * | 1/1990 | McCullough | F04C 29/0021 418/55.6 |
| 4,975,031 | A | 12/1990 | Bagepalli et al. | |
| 5,354,278 | A | 10/1994 | Kriesel | |
| 5,479,899 | A | 1/1996 | Phelps | |
| 5,571,244 | A | 11/1996 | Andres | |
| 5,775,886 | A | 7/1998 | Terwilliger | |
| 5,992,296 | A | 11/1999 | Murata | |
| 6,340,161 | B1 | 1/2002 | Zitting et al. | |
| 6,517,081 | B2 | 2/2003 | Zitting et al. | |
| 6,543,485 | B2 | 4/2003 | Henry et al. | |
| 6,595,105 | B2 | 7/2003 | An et al. | |
| 6,672,337 | B2 | 1/2004 | Kobayashi et al. | |
| 7,189,068 | B2 | 3/2007 | Thomas, Jr. et al. | |
| 8,734,139 | B2 | 5/2014 | Burns et al. | |
| 9,140,260 | B2 | 9/2015 | Huang et al. | |
| 10,094,372 | B2 | 10/2018 | Stein et al. | |
| 2002/0158419 | A1 | 10/2002 | Zitting et al. | |
| 2002/0166718 | A1 * | 11/2002 | Gadefatt | F02K 1/827 181/225 |
| 2003/0099558 | A1 | 5/2003 | Chang | |
| 2003/0159743 | A1 * | 8/2003 | Kobayashi | F16L 55/045 138/30 |
| 2004/0160120 | A1 | 8/2004 | Weh et al. | |
| 2006/0065478 | A1 * | 3/2006 | Rockwell | F01C 21/10 181/250 |
| 2007/0237658 | A1 | 10/2007 | Burns et al. | |
| 2007/0274858 | A1 * | 11/2007 | Childers | A61L 2/24 422/28 |
| 2008/0022850 | A1 | 1/2008 | Kim et al. | |
| 2008/0260546 | A1 * | 10/2008 | Shoulders | F04C 29/061 417/312 |
| 2009/0060728 | A1 | 3/2009 | Grimes et al. | |
| 2009/0060759 | A1 * | 3/2009 | Sishtla | F04C 29/063 417/312 |
| 2010/0050622 | A1 | 3/2010 | Stroganov | |
| 2010/0269798 | A1 | 10/2010 | Prior | |
| 2011/0110793 | A1 | 5/2011 | Leugemors et al. | |
| 2011/0300014 | A1 | 12/2011 | Huang et al. | |
| 2012/0313307 | A1 * | 12/2012 | Cartwright | C08J 5/042 267/141 |
| 2014/0130887 | A1 | 5/2014 | Byrne et al. | |
| 2015/0275897 | A1 * | 10/2015 | Field | F04B 49/06 418/1 |
| 2016/0131139 | A1 * | 5/2016 | Mehta | F04C 29/065 418/1 |
| 2017/0190864 | A1 * | 7/2017 | Kocurek | C08J 9/32 |
| 2019/0316589 | A1 * | 10/2019 | Endou | F04B 39/12 |

FOREIGN PATENT DOCUMENTS

| | | | |
|---|---|---|---|
| DE | 27 33 902 | A1 | 2/1978 |
| EP | 1 336 791 | A1 | 8/2003 |
| GB | 562 576 | | 7/1944 |
| GB | 1 009 689 | | 11/1965 |
| JP | H0828438 | | 1/1996 |
| JP | H08-145271 | A | 6/1996 |
| JP | H11315784 | A | 11/1999 |
| JP | 2005538299 | A | 12/2005 |
| JP | 2011038423 | A | 2/2011 |
| NL | 268601 | | 6/1964 |

OTHER PUBLICATIONS

Chinese Office Action and English Translation for Serial No. 2016800265620 dated May 12, 2018.

Japanese Office Action and English Translation for Serial No. 2017558016 dated Oct. 14, 2020.

Japanese Office Action and English Translation for Serial No. 2017558016 dated Jun. 2, 2020.

* cited by examiner

FLUID WORKING SYSTEMS

CROSS-REFERENCE TO RELATED APPLICATIONS

This application is a National Stage application of International Patent Application No. PCT/US2016/031098, filed on May 6, 2016, which claims priority to U.S. patent application Ser. No. 14/707,727, filed on May 8, 2015, each of which is hereby incorporated by reference in its entirety.

FIELD OF THE INVENTION

This invention relates generally to fluid working system, and, in one aspect, particularly hydraulic systems, and more particularly to positive displacement machines and digital positive displacement machine for a working fluid.

BACKGROUND

Fluid working systems or machines provide means whereby working fluid is either displaced by or displaces displacement means, such as a piston, within the confines of a working chamber, such as a working chamber which is defined in a cylinder, with such displacement usually occurring cyclically. However, this cyclic operation of such positive displacement machines generate pressure fluctuations and such fluctuations, in particular, within the inlet system may cause a reduction in efficiency and therefore increased power demands or create noise and vibration.

In particular working fluid systems, including Digital Displacement Pumps (DDPs), can produce large flow and pressure ripples within the pump itself and also within the entire working fluid system. This creates several issues: acoustic noise which is not acceptable to the machine operator; an acoustic quality which can be very harsh; vibration which is an ergonomic issue for the operator, but also can cause problems with machine control; and endurance problems—the large pressure ripple can reduce the lifetime of pump and system components. These problems are amplified in systems that are very stiff where little hydraulic compliance such as in the form of the flexibility of the hydraulic oil and hydraulic hoses exist to absorb the flow pulses and reduce the pressure ripples.

SUMMARY

In one aspect the present invention may broadly be said to consist in a fluid working system for a working fluid including a positive displacement machine, said positive displacement machine comprising: at least one working chamber and, at least two, fluid port means allowing working fluid to flow into and out of said working chamber, displacement means within, or defined by, said working chamber to displace, or be displaced by, working fluid from one fluid port means to another, wherein that the fluid working system has associated therewith a compliance volume smoothing pressure fluctuations of said working fluid within said fluid working system.

In one aspect, the present invention may broadly be said to comprise a fluid working system for a working fluid including a positive displacement machine, said positive displacement machine comprising: at least one working chamber and, at least two, fluid port means allowing working fluid to flow into and out of said working chamber, displacement means within, or defined by, said working chamber to displace, or be displaced by, working fluid from one fluid port means to another, characterised in that the fluid working system has associated therewith a compliance volume smoothing pressure fluctuations of said working fluid within said fluid working system.

In some preferred forms of the invention, said fluid port means are operable to be individually opened and closed at a selected rate.

In some preferred forms of the invention, the compliance volume is housed within the working chamber.

In some preferred forms of the invention, said compliance volume comprises a volume of material selected from Syntactic foam, micro-balloon material, micro or macro-sphere material, ceramic matrix material, voided media.

In some preferred forms of the invention, the volume of material is held in place by means of one or more protrusions from the interior of the working chamber.

In another aspect, a preferred form of the present invention may broadly be said to comprise a positive displacement pump for displacing a working fluid, including at least one cylinder each including a working end defining a working chamber and at least two fluid port means allowing working fluid to flow into and out of said working chamber, a piston moving within said working chamber to displace working fluid flowing from one fluid port means to another; characterised in that the positive displacement pump has associated therewith a compliance volume smoothing pressure fluctuations of said working fluid displaced by said pump.

In some preferred forms of the invention, wherein the compliance volume is housed within the cylinder.

In some preferred forms of the invention, the compliance volume is housed within the working chamber.

In some preferred forms of the invention, said compliance volume comprises a volume of material selected from Syntactic foam, micro-balloon material, micro or macro-sphere material, ceramic matrix material, and voided media.

In some preferred forms of the invention, the volume of material is held in place by means of one or more protrusions from the interior of the cylinder.

In yet another aspect, a form of the present invention may broadly be said to consist in a digital positive displacement pump for displacing a working fluid, including at least one cylinder each including a working end defining a working chamber and at least two fluid port means allowing working fluid to flow into and out of said working chamber, a piston moving within said working chamber to displace working fluid flowing from one fluid port means to another, said fluid port means being operable to be individually opened and closed at a selective rate independently of movement of the each piston; characterised in that the positive displacement pump has associated therewith a compliance volume smoothing pressure fluctuations of said working fluid displaced by said positive displacement pump.

In yet another aspect, the present invention may broadly be said to consist in the use of syntactic foam in a positive displacement machine to provide a compliance volume retained within the piston assembly thereby reducing pressure ripple.

In yet another aspect the present invention may broadly be said to consist in a method of retaining a volume of syntactic foam within a positive displacement machine by means of retaining rings.

In yet a further aspect the present invention may broadly be said to consist in a fluid working system comprising a positive displacement machine comprising a compliance volume of syntactic foam to provide pressure ripple reducing means.

In yet a further aspect, the present invention may broadly be said to consist in a positive displacement pump for displacing a working fluid, including at least one cylinder each including a working end defining a working chamber and at least two fluid port means allowing working fluid to flow into and out of said working chamber, a piston moving within said working chamber to displace working fluid flowing from one fluid port means to another; characterised in that said working chamber contains a compliance volume of syntactic foam smoothing pressure fluctuations of said working fluid displaced by said pump.

In some preferred forms of the invention, said fluid port means are operable to be individually opened and closed at a selective rate independently of displacement of said displacement means.

BRIEF DESCRIPTION OF THE DRAWINGS

Specific embodiments of the present disclosure will now be described in detail with reference to the accompanying figures in which.

DETAILED DESCRIPTION

Figure 1:
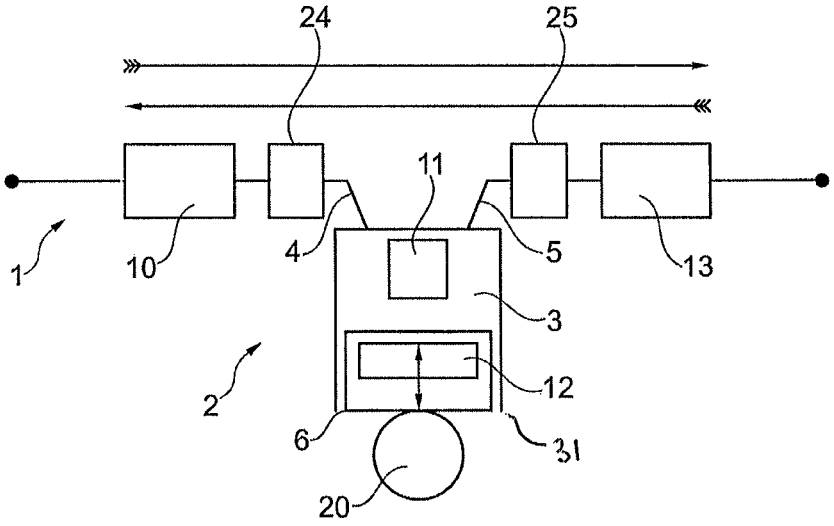
FIG. 1 shows a schematic form of a working fluid working system according to a form of the present invention.
Figure 2:
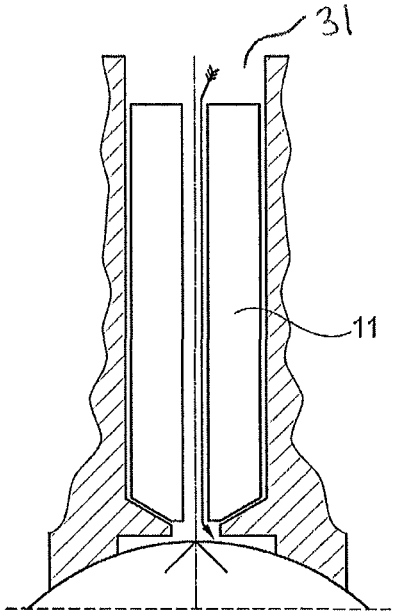
FIG. 2 shows a partial sectional view of a working chamber according to a form of the present invention.
Figure 3:
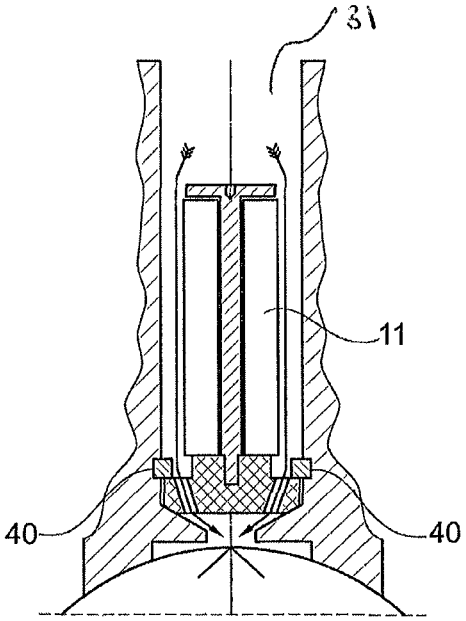
FIG. 3 shows a partial sectional view of a working chamber according to a form of the present invention.
Figure 4:
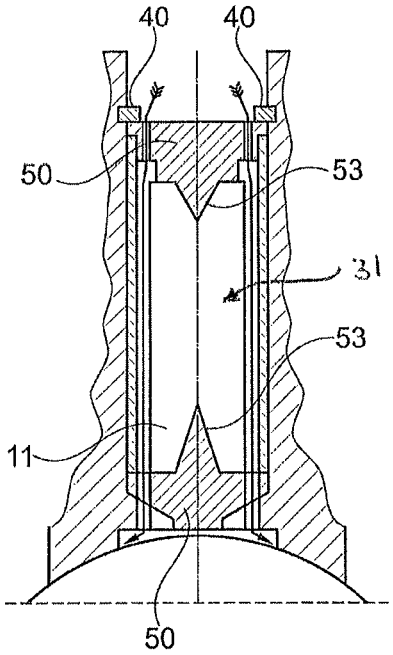
FIG. 4 shows a partial sectional view of a working chamber according to a form of the present invention.
Figure 6:
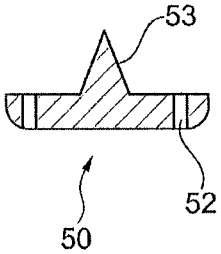
FIG. 6 shows a partial sectional view of a form of the present invention.
Figure 5:
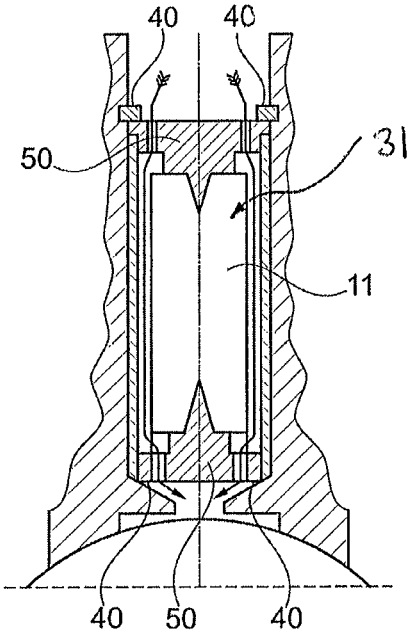
FIG. 5 shows a partial sectional view of a working chamber according to a form of the present invention.
Figure 7:
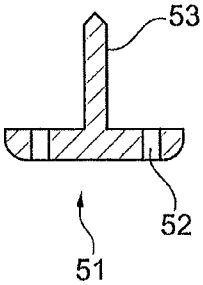
FIG. 7 shows a partial sectional view of a form of the present invention.
Figure 8:
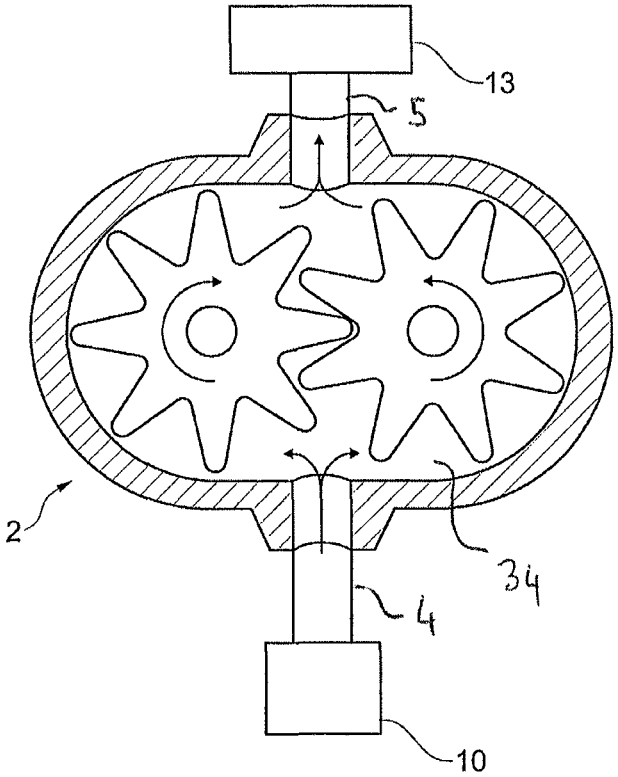
FIG. 8 shows a partial sectional view of a form of the present invention.
Figure 9:
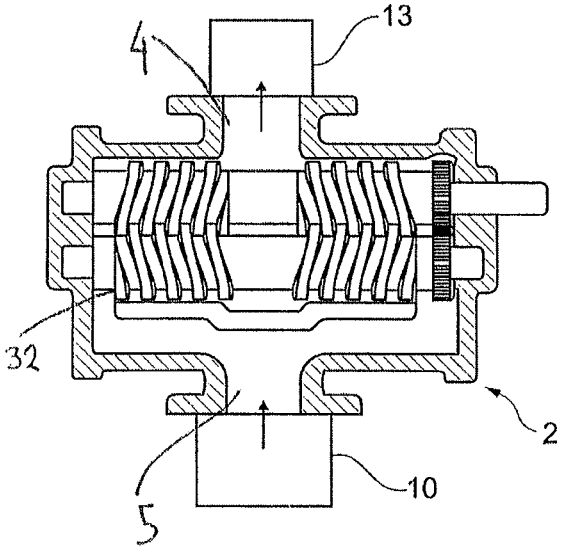
FIG. 9 shows a partial sectional view of a form of the present invention.
Figure 10:
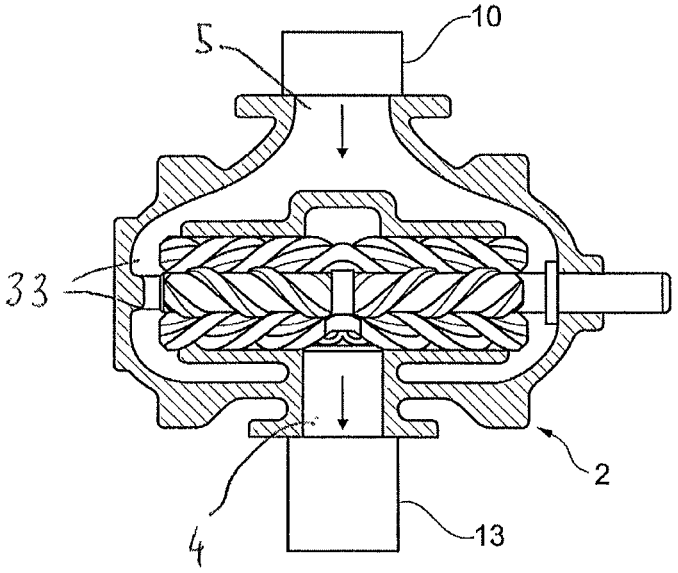
FIG. 10 shows a partial sectional view of a form of the present invention.
Figure 11:
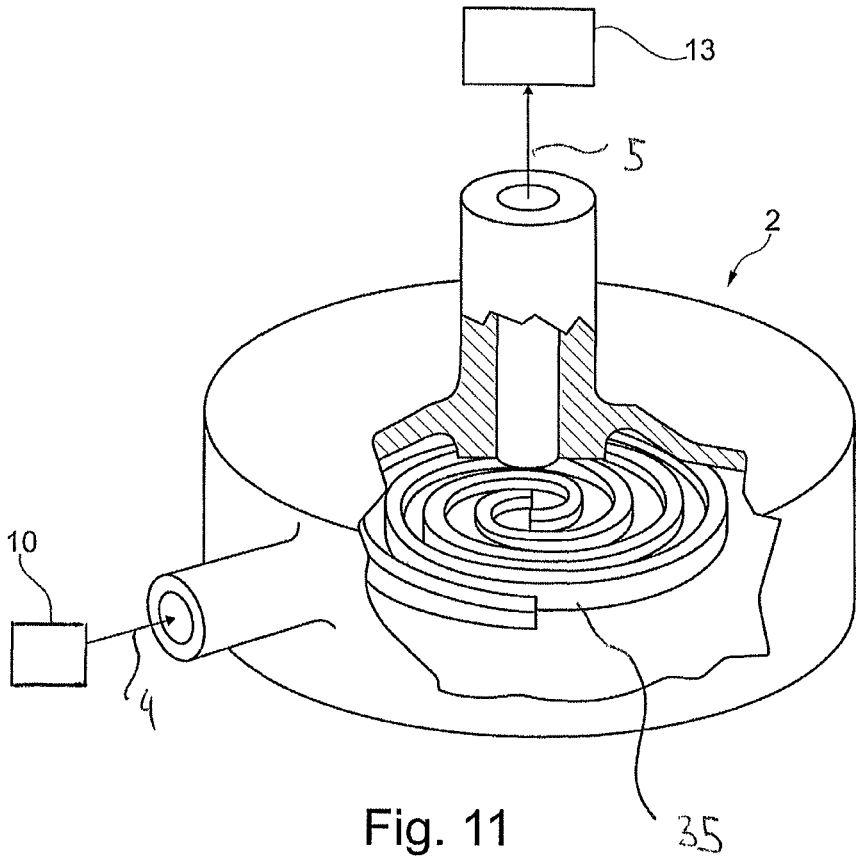
FIG. 11 shows a partial perspective sectional view of a form of the present invention.

Like elements in the various figures may be denoted by like reference numerals for consistency. Further, in the following detailed description of embodiments of the present disclosure, numerous specific details are set forth in order to provide a more thorough understanding of the invention. However, it will be apparent to one of skill in the art to which the invention relates that the embodiments disclosed herein may be practiced without these specific details. In other instances, well-known features have not been described in detail to avoid unnecessarily complicating the description.

In one form the present invention takes the form of a fluid working system 1 which is provided for a working fluid, such fluid working systems 1 may simply move working fluid from one location to another and these are often described as open systems. For example such a fluid working system 1 may be used to move working fluid to where it is needed for some purpose. In particular examples of such fluid working system 1 the working fluid so moved may comprise a slurry of particles entrapped in the working fluid, this may take the form of mined particles to be moved from an underground location to the surface. Other working systems may be closed, that is the system forms a cycle in which the working fluid is moved around a circuit until it returns to a start where is again moved around. The working fluid may comprise a liquid or gel, examples of such liquids includes hydraulic fluid which may be used to power devices such as power steering units or various implements such as diggers. These devices are well known to those skilled in the art to which the invention relates and so will not be described in detail. One particular embodiment of a closed fluid working system 1 is a refrigeration system in such cases the working fluid may change state from liquid to gas and gas to liquid and it expands and is compressed by the system. The fluid working system 1 thus further includes components such as expansions valves 24, 25 and compressors and these will not be described in any great detail as they are known to those skilled in the art.

The fluid working system 1 whether open or closed will further include various suitable pipes or hoses, with the hoses in general providing some flexibility to allow for movement of parts or repositioning of parts of the system as required. Further, the fluid working system 1 may further include various gauges such and pressure gauges and other sensors such as temperature sensors to monitors various aspects of conditions in the fluid working system 1. Again, as these are well known to those skilled in the art to which the inventions relates these will not be described in any great detail.

Embodiments of the present invention include a positive displacement machine 2. This positive displacement machine 2 may include at least one working chamber 3 the working chamber may for example comprise a cylinder 31 or in other examples comprise a cavity 32, 33 which is created by two or more spirals or helixes interacting. In the spiral form 32, 33 embodiment the spirals move relative to each other so that the cavity there between both deceases in size and, in some cases, move. A particular form of this embodiment is a scroll compressor which is known for use in cooling or for other fluid compression or expansion and are typically comprised of two upstanding interfitted involute spiral wraps moving about respective axes to create a working chamber 35. Each of these respective involute wraps is mounted on an end plate and has a tip in contact or near-contact with the end plate of the other respective scroll wrap. The wraps are urged in a nutating motion relate to each other. The interacting helix form of positive displacement machine 2 may comprise a pair of helixes mounted on parallel axis which interact.

Other known forms of such positive displacement pumps use a swash plate to translate rotational motion into reciprocating which is then used in a similar manner to a crankshaft to drive series of pistons 6 aligned coaxially with a shaft through a the swashplate.

Yet another form of positive displacement machine 2 takes the form of a progressive cavity pump. This may consist of a helical rotor with a twin helix of twice the wavelength and double the diameter helical hole in a stator which is typically rubber or other suitable flexible material. The rotor seals tightly against the stator when rotating and thus form a set of fixed-size cavities in between. The cavities move when the rotor is rotated but their shape or volume does not change. The pumped working fluid is moved or displaced within these cavities.

Rotary positive displacement pumps in general, are known to those skilled in the art to which this invention relates, e.g., which may include an internal or external gear pump, a lobe pump, a vane pump or a progressive cavity pump, and as such will not be described in detail herein. Moreover, the scope of the invention is not intended to be limited to any particular type or kind of positive displacement machine 2 thereof that is either now known or later developed in the future. By way of example, such rotary positive displacement pumps are understood to include a motor or motor portion for driving a pump or pump portion, and may include a module like element for implementing some functionality related to controlling the basic operation of the motor for driving the pump. By way of example, and consistent with that set forth herein, the motor is understood to receive control signals from the signal processor in order to drive and control the rotary positive displacement pump to pump fluid. The motor is also understood to provide the signalling containing information about power, torque and speed related to the operation of the pump.

A pump is a mechanical device that moves, changes the pressure of or displaces a working fluid, that is, liquids, including gels, or gases, or sometimes slurries by mechanical action. Herein for simplicity the phrase "working fluid" will be used to describe the fluid so moved or displaced but those skilled in the art to which the invention relates will appreciate that the working fluid may contain a mixture of liquid and gas and may further include particles of solid in the form of a slurry, these particles may be of a substance entrapped and carried by the working fluid or may comprise the working fluid in a solid state. When used with a non-compressible working fluid pumps will move or displace the working fluid but when used with a compressible working fluid there will be some degree of pressure increase or compression of the working fluid. For simplicity herein the displacement or moveable of the working fluid will be the main focus of the description. Further, in some cases the working fluid may completely or partially change state as it moves around a fluid system, for example, this may occur in a refrigeration system, where the working fluid is compressed into a liquid state and expands into a gaseous one as it cycles. Again, for simplicity the substance will be referred to as a working fluid.

Pumps may be said to raise, transfer, deliver, or compress fluids or attenuate gases especially by suction or pressure or both. Pumps can be classified into three major groups according to the method they use to move the fluid: direct lift, displacement, and gravity pumps. Pumps operate by some mechanism, for example, reciprocating or rotary, and consume energy to perform mechanical work by moving or displacing the working fluid. Such pumps may operate via many energy sources, for example, by hand, electricity, or wind power, and may come in many sizes, from microscopic which can be uses in medical applications to large ones that find use in industry.

Syntactic foams are generally low density, high specific strength composite materials synthesized by filling a material, for example, a metal, a polymer, or a ceramic matrix with hollow particles called micro-balloons. Many properties of syntactic foam are dependent upon the material used in their manufacture but other properties depend on the volume fraction or density of the micro-balloons. Materials such as these provide an effective amount of compliance in a relatively small and cost effective package. Typically in hydraulic systems there is a limited array of choices for active hydraulic compliance—accumulators of some kind, hydraulic hoses, or hydraulic oil itself and these tend to be large or expensive.

In forms of the invention the foam may be shaped so that it can be fitted into the working chamber for example it may comprises a cylinder of appropriate size with a central hole there through. In this form the foam may be machined using known techniques or may be manufactured or moulded. In some forms of the invention appropriate means 50, 51 may be used to hold the shaped foam in position. In other embodiments protrusions such as raised spikes or tabs 53 may be used, these protrusions may be machined on, for example, the interior surfaced of the working chamber or attached thereto and in this case may take the form of pins. In this form the invention the compliance volume 10, 11 is held away from the surfaces or control surfaces so that when it is compressed under pressure it does not rub. The intention of such protrusions in to hold the shaped foam in place and thus they are required to resist the cycling of the working fluid through the fluid working system. In such forms of the invention a flow path needs to be provided for the working fluid either through or around the compliance volume 10, 13 or both. In other embodiments of the prevent invention means 50, 51 are provided to retain a compliance volume within a working chamber 31 by means of a working chamber engagement means, for example a retaining ring that abuts the interior of the working chamber and means, for example a protrusion or spike 53 that extends into the compliance volume 11, in forms of the invention this extension may extend along the axis of the working chamber 31 or cylinder and the working chamber engagement means 50, 51 includes working fluid apertures 52 there through thus allowing the working to pass.

In other embodiments of the invention the compliance volume 10, 13 comprises a volume in fluid communication with the fluid ports 4, 5. In some embodiments of the invention one port 4 or 5 may continuously act as inlet and the other an outlet 4 or 5 and thus the compliance volume 10, 13 may be said to be upstream or downstream of the working chamber 31, 32, 33, 34, 35 or on the high or low pressure side. In other embodiments of the invention the fluid ports 4, 5 may alternate in function as an inlet and outlet, in this case the compliance volume 10, 13 is not continually upstream/high pressure or downstream/low pressure. In this embodiment of the invention the compliance volume 10, 13 may be surrounded by an extension or budge in the piping of tubing, in other cases a separate fluid impervious housing may be provided surrounding the compliance volume 10, 13 in fluid communication with the tubing or piping. In yet other embodiments of the invention the housing may be able to be opened or removed to allow the compliance volume 10, 11, 13 to be inspected or replaced.

In forms of the inventions there are provided at least two, fluid port means 4, 5 which allow the working fluid to flow into and out of said working chamber. These may take the form of inlet valves 24, 25 to direct the flow of working fluid; in other embodiments these valves 24, 25 may be electronically controlled so as to allow the entrance and exit of working fluid at a selective rate which is independent of the rate of movement or displacement of the displacement means, for example in form of the invention in with a piston 6 reciprocating within a cylinder, the fluid ports 4, 5 may operate at a different rate from the cycling of the piston 6 with the cylinder. In some forms these fluid port means 4, 5 may be bi-directional, that is they may function as valves 24, 25 that may be used as an inlet or outlet as required by the system or user. It should be noted that various other valves may be provided in the fluid working system, these valves along with previously mentioned gauges and sensors allowing the fluid working system 1 to be monitored and controlled.

In embodiments of the present invention the associated compliance volume which may be in fluid communication with the working chamber or contained within the working chamber acts to smooth pressure fluctuations or rapid changes within the fluid working system 1 by providing a non-dead volume containing a series of very small sub-volumes, these sub-volumes may be the micro-balloons within the Syntactic foam. These pressure fluctuations or rapid changes within the fluid working system 1 may create noise or otherwise decrease the efficiency of the system. Therefore their reduction may act to increase overall efficiency of the fluid working system 1.

In embodiments of the invention the compliance volume 10, 11, 13 may be positioned between a low pressure fluid source and a low pressure fluid inlet. In this form of the invention the compliance volume may act to supply high frequency components of the working fluid flow supplied to the working chamber and further to absorb high frequency components of the working fluid flow delivered to the low pressure source from the working chamber 31, 32, 33, 34, 35. In this case the pressure fluctuation smoothing may act to reduce working fluid cavitation and thus increase efficiency or component life.

In other embodiments of the invention the compliance volume 11, 12 may be provided associated with or attached to the working chamber, for example, cylinder. The compliance may be present on the cylinder side or the piston 6 side and there may be design considerations that dictate which of these is used. Here the compliance volume 11, 12 may function to slow the pressure rise within the working chamber and thus act to reduce shock within the fluid working system 1. This is particularly a consideration during part stroke operation of the fluid working system 1. However, there may be a reduction in the effective displacement of the fluid working system 1 in doing this but this can be accommodated by appropriate design. Further as the behaviour is very repeatable it can assist in reducing hydraulic machine effective torque with higher pressure to reduce the likelihood of engine stalling.

In other embodiments of the present invention the compliance volume 10, 13 is positioned downstream from the high pressure fluid port and functions to reduce the pressure flow or ripple which is produced in the working chamber 31, 32, 33, 34, 35 and thus transmitted to the rest of the fluid working system 1. In other forms of the present invention the compliance volume 10, 11, 13 acts to limit the pressure ripple transmitted to the working chamber from the rest of the fluid working system 1.

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention. In particular, it will appreciated that it is possible to describe an embodiment of a fluid working system functioning as a pump, for example a digital displacement pump whereas one skilled in the art to which the invention relates will realise that the functioning of a similar device as a motor is disclosed. For example, in general, a positive displacement pump can function as a positive displacement motor if a flow of working fluid and appropriate valves are provided, obviously in this case the motor driving the pump is not required.

Those skilled in the art to which this invention relates will appreciate that various modifications and variations can readily be implemented without departing from the scope of this disclosure. There will be other embodiments that are apparent to those skilled in the art to which this invention relates after consideration of the specification and practice of hydraulic machines and positive displacement machines including, in particular, digital positive displacement pumps disclosed herein. In particular, those skilled in the art to which the invention relates will realise that pumps and machines may use a single working chamber or multiple working chambers, in general in this description one such chamber is described for simplicity. It is therefore intended that the disclosure of these embodiments be considered as exemplary only, with a true scope of the disclosed embodiments being indicated by the following claims and their equivalents.

What is claimed is:

1. A hydraulic fluid working system for a working fluid including a positive displacement machine, said positive displacement machine comprising:

at least one working chamber and, at least two, fluid port means allowing working fluid to flow into and out of said working chamber, displacement means within, or defined by, said working chamber to displace, or be actuated by, a liquid or gel working fluid from one fluid port means to another, wherein the fluid working system has associated therewith a first and second compliance volume smoothing pressure fluctuations of said working fluid within said fluid working system, wherein a first fluid port of the at least two fluid port means fluidly connects the first compliance volume with the working chamber and a second fluid port of the at least two fluid port means fluidly connects the second compliance volume with the working chamber, and wherein said fluid port means comprises valves operable to be individually opened and closed at a selected rate independently of movement of the displacement means.

2. The hydraulic fluid working system as claimed in claim 1 wherein the compliance volume is housed within the working chamber.

3. The hydraulic fluid working system as claimed in claim 2 wherein the compliance volume is housed within the displacement means.

4. The hydraulic fluid working system as claimed in claim 1, wherein said compliance volume comprises a volume of material selected from Syntactic foam, micro-balloon material, micro or macro -sphere material, ceramic matrix material, voided media.

5. The hydraulic fluid working system as claimed in claim 1, wherein the volume of material is held in place by means of one or more protrusions from the interior of the working chamber.

* * * * *